US009875837B2

(12) United States Patent
Jeong et al.

(10) Patent No.: US 9,875,837 B2
(45) Date of Patent: Jan. 23, 2018

(54) COIL ELECTRONIC COMPONENT

(71) Applicant: SAMSUNG ELECTRO-MECHANICS CO., LTD., Suwon-si, Gyeonggi-do (KR)

(72) Inventors: Dong Jin Jeong, Suwon-si (KR); Kyung Seop Lee, Suwon-si (KR)

(73) Assignee: Samsung Electro-Mechanics Co., Ltd., Suwon-si, Gyeongi-do (KR)

( * ) Notice: Subject to any disclaimer, the term of this patent is extended or adjusted under 35 U.S.C. 154(b) by 0 days.

(21) Appl. No.: 15/088,653

(22) Filed: Apr. 1, 2016

(65) Prior Publication Data

US 2016/0307689 A1 Oct. 20, 2016

(30) Foreign Application Priority Data

Apr. 16, 2015 (KR) ..... 10-2015-0053984

(51) Int. Cl.

| | |
|---|---|
| ***H01F 27/28*** | (2006.01) |
| ***H01F 5/00*** | (2006.01) |
| ***H01F 27/24*** | (2006.01) |
| ***H01F 17/04*** | (2006.01) |
| ***H01F 17/00*** | (2006.01) |

(52) U.S. Cl.

CPC ..... *H01F 17/04* (2013.01); *H01F 17/0013* (2013.01); *H01F 2017/002* (2013.01); *H01F 2017/048* (2013.01)

(58) Field of Classification Search

CPC ..... H01F 27/2804; H01F 27/255; H01F 17/0013; H01F 17/04; H01F 2017/048; H01F 2017/002

USPC ..... 336/200, 223, 233

See application file for complete search history.

(56) References Cited

U.S. PATENT DOCUMENTS

| | | | | |
|---|---|---|---|---|
| 7,106,161 | B2 | 9/2006 | Tozawa et al. | |
| 2006/0006972 | A1* | 1/2006 | Tozawa | H01F 17/0013 336/200 |
| 2009/0153282 | A1* | 6/2009 | Taoka | H01F 17/0013 336/200 |

(Continued)

FOREIGN PATENT DOCUMENTS

| | | | |
|---|---|---|---|
| JP | 11-204337 | A | 7/1999 |
| JP | 2003-297633 | A | 10/2003 |
| JP | 2006-032430 | A | 2/2006 |

(Continued)

OTHER PUBLICATIONS

Korean Office Action issued in Application No. 10-2015-0053984 dated May 22, 2017, with English translation.

*Primary Examiner* — Mangtin Lian

(74) *Attorney, Agent, or Firm* — McDermott Will & Emery LLP

(57) ABSTRACT

A coil electronic component includes a first coil disposed on a first surface of an insulating substrate; a second coil disposed on a second surface of the insulating substrate opposing the first surface; a via connecting the first and second coils through the insulating substrate; a first via pad formed as one end of the first coil extending and disposed on the first surface of the insulating substrate to cover the via; and a second via pad formed as one end of the second coil extending and disposed on the second surface of the insulating substrate to cover the via. Upper surfaces of the first and second via pads have rounded corners.

17 Claims, 5 Drawing Sheets

(56) References Cited

U.S. PATENT DOCUMENTS

2013/0249664 A1* 9/2013 Tonoyama ..... H01F 41/04
336/200

FOREIGN PATENT DOCUMENTS

JP 2007-067214 A 3/2007
KR 10-2013-0109048 A 10/2013

* cited by examiner

I - I'

COIL ELECTRONIC COMPONENT

CROSS-REFERENCE TO RELATED APPLICATION

This application claims the benefit of priority to Korean Patent Application No. 10-2015-0053984, filed on Apr. 16, 2015 with the Korean Intellectual Property Office, the entirety of which is incorporated herein by reference.

TECHNICAL FIELD

The present disclosure relates to a coil electronic component.

BACKGROUND

An inductor, a type of coil electronic component, is a typical passive element forming an electronic circuit along with a resistor and a capacitor to remove noise therefrom.

A thin film type inductor is manufactured by forming an internal coil part through plating, curing a magnetic powder-resin complex as a mixture of magnetic powder and a resin to form a magnetic body, and subsequently forming external electrodes on outer surfaces of the magnetic body.

SUMMARY

An aspect of the present disclosure provides a coil electronic component free from shorts due to a via pad and loss of inductance due to an area of the via pad.

According to an embodiment in the present disclosure, a coil electronic component comprises a first coil disposed on a first surface of an insulating substrate; a second coil disposed on a second surface of the insulating substrate opposing the first surface; a via connecting the first and second coils through the insulating substrate; a first via pad formed as one end of the first coil extending and disposed on the first surface of the insulating substrate to cover the via; and a second via pad formed as one end of the second coil extending and disposed on the second surface of the insulating substrate to cover the via. Upper surfaces of the first and second via pads have rounded corners.

The upper surfaces of the first and second via pads may have a shape corresponding to overlapping regions of a rounded shape and a square having a side whose length is smaller than a longer axis of the rounded shape.

One side of the square may correspond to an extending line of an outer coil line of one end of each of the first and second coils conductors.

A difference between the longer axis of the rounded shape and the length of the side of the virtual square may be 30 μm or less.

The upper surfaces of the first and second via pads may have corner portions configured as circular arcs and a straight line linking the corner portions.

A plurality of corner portions formed in the first via pad or the second via pad may have the same radius of curvature.

A through hole may be formed in a central portion of the insulating substrate and filled with a magnetic material to form a core part.

The first and second via pads may protrude toward the core part.

The first and second coils and the first and second via pads may be plated via pads.

The coil electronic component may further comprise a magnetic body in which the first and second coils are embedded. The magnetic body may include magnetic metal powder.

According to another embodiment in the present disclosure, a coil electronic component comprises a first coil disposed on a first surface of an insulating substrate; a second coil disposed on a second surface of the insulating substrate opposing the first surface; a via connecting the first and second coils through the insulating substrate; a first via pad formed as one end of the first coil extending and disposed on the first surface of the insulating substrate to cover the via; and a second via pad formed as one end of the second coil extending and disposed on the second surface of the insulating substrate to cover the via. Upper surfaces of the first and second via pads have a quadrangular shape in which corner portions are curved.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
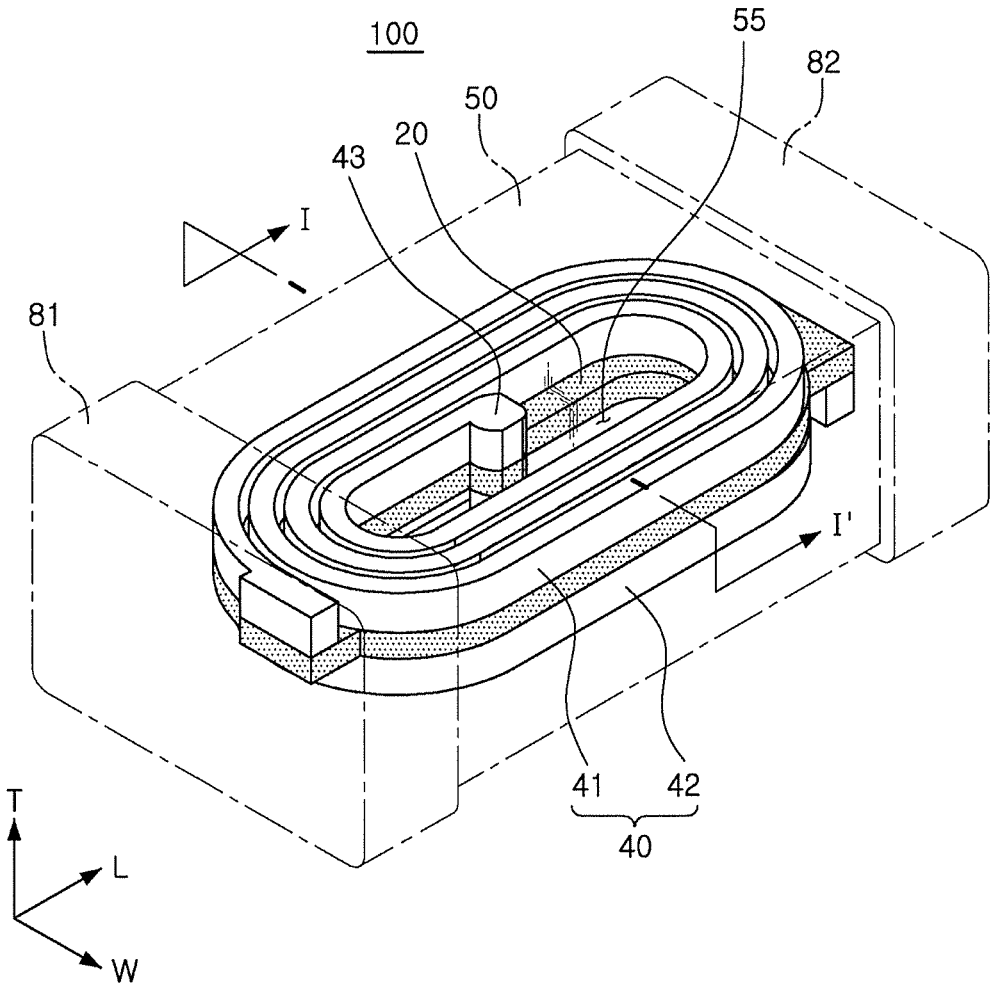
FIG. 1 is a perspective view schematically illustrating a coil electronic component including an internal coil unit according to an exemplary embodiment in the present disclosure.

Hereinafter, exemplary embodiments of the present inventive concept will be described in detail with reference to the accompanying drawings. The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art. In the drawings, the shapes and dimensions of elements may be exaggerated for clarity, and the same reference numerals will be used throughout to designate the same or like elements To clarify the present invention, portions irrespective of description are limited and like numbers refer to like elements throughout the specification, and in the drawings, the thickness of layers, films, panels, regions, etc., are exaggerated for clarity. Also, in the drawings, like reference numerals refer to like elements although they are illustrated in different drawings.

Throughout the specification, unless explicitly described to the contrary, the word "comprise" and variations such as "comprises" or "comprising" will be understood to imply the inclusion of stated elements but not the exclusion of any other elements.

Coil Electronic Component

Hereinafter, a thin film type inductor will be described as an example of a coil electronic component according to an exemplary embodiment, but the coil electronic component is not limited thereto.

FIG. 1 is a perspective view schematically illustrating a coil electronic component including an internal coil unit according to an exemplary embodiment.

Referring to FIG. 1, a thin film type inductor used in a power line of a power supply circuit is disclosed as an example of a chip electronic component.

The coil electronic component 100 according to an exemplary embodiment includes a magnetic body 50, internal coil units 40 embedded in the magnetic body 50, and first and second external electrodes 81 and 82 disposed on external surfaces of the magnetic body 50 and connected to the internal coil units 40.

In the coil electronic component 100 according to an exemplary embodiment, it is defined that a length direction is the "L" direction, a width direction is the "W" direction, and a thickness direction is the "T" direction in FIG. 1.

The magnetic body 50 may form external surfaces of the coil electronic component 100, and may be formed of ferrite or magnetic metal powder.

Ferrite may be, for example, an Mn—Zn-based ferrite, an Ni—Zn-based ferrite, an Ni—Zn—Cu-based ferrite, an Mn—Mg-based ferrite, a BA-based ferrite, or an Li-based ferrite.

The magnetic metal powder may include any one selected from the group consisting of Fe, Si, Cr, Al, and Ni, and may be an Fe—Si—B—Cr-based amorphous metal, but the material of the magnetic metal powder is not limited thereto.

A particle diameter of the magnetic metal powder may range from 0.1 μm to 30 μm, and may be included in a thermosetting resin such as epoxy or polyimide in a dispersed manner.

The internal coil units 40 disposed within the magnetic body 50 may include a first coil 41 formed on a first surface of the insulating substrate 20 and a second coil 42 formed on a second surface of the insulating substrate 20 opposite the first surface thereof.

The first and second coils 41 and 42 may have a planar coil shape formed on the same plane of the insulating substrate 20. The first and second coils 41 and 42 may have a spiral shape.

The first and second coils 41 and 42 may be formed through electroplating, but the method of forming the first and second coils 41 and 42 is not limited thereto.

The first and second coils 41 and 42 may be covered with an insulating layer (not shown), and thus may not be in direct contact with the magnetic material forming the magnetic body 50.

The insulating substrate 20 may be formed as, for example, a polypropylene glycol (PPG) substrate, a ferrite substrate, or a metal-based soft magnetic substrate.

A through hole is formed in a central portion of the insulating substrate 20. The through hole is filled with a magnetic material to form a core part 55. Since the core part 55 is formed by filling the through hole with a magnetic material, inductance (L) may be enhanced.

Figure 2:
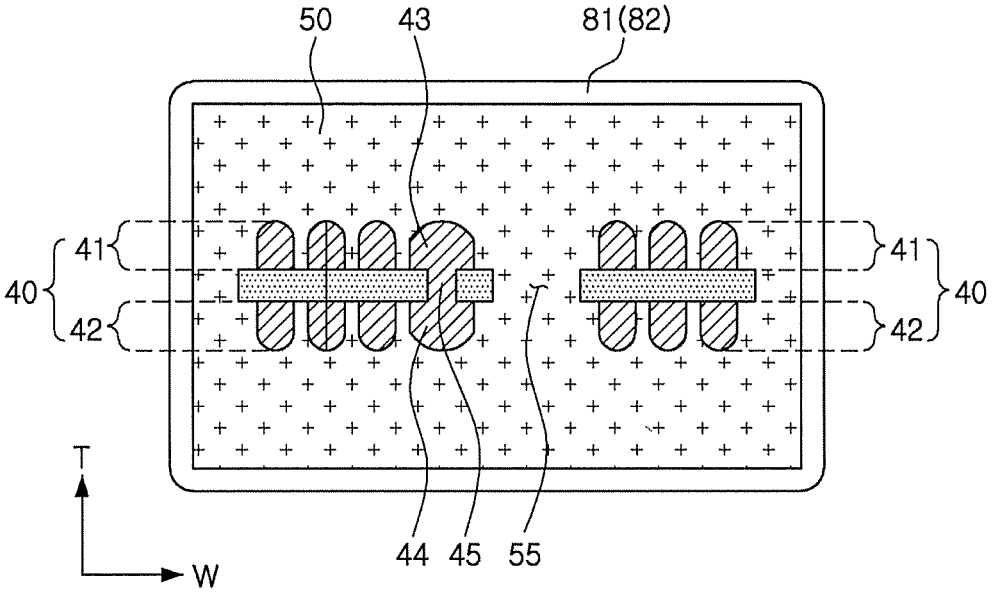
FIG. 2 is a cross-sectional view taken along line I-I' of FIG. 1.

FIG. 2 is a cross-sectional view taken along line I-I' of FIG. 1.

Referring to FIG. 2, the first and second coils 41 and 42 respectively formed on the first and second surfaces of the insulating substrate 20 are connected by a via 45 formed to penetrate through the insulating substrate 20.

The first and second internal coil conductors 41 and 42 and the via 45 may be formed to include a metal having excellent electrical conductivity, such as silver (Ag), palladium (Pd), aluminum (Al), nickel (Ni), titanium (Ti), gold (Au), copper (Cu), platinum (Pt), or alloys thereof.

In order to cover the via 45, first and second via pads 43 and 44 are formed on the first and second surfaces of the insulating substrate 20, respectively.

One end of the first coil 41 extends to form the first via pad 43, and one end of the second coil 42 extends to form the second via pad 44.

Like the first and second coils 41 and 42, the first and second via pads 43 and 44 may be formed through electroplating.

If via pads 43 and 44 and the via 45 are not aligned, an electrical connection may be cut off, generating an open defect, and thus, the via pads 43 and 44 are generally formed to be sufficiently large.

If, however, the via pads 43 and 44 are increased in size, an area of the core part formed at an inner portion of the internal coil units 40 may be reduced, a magnetic material filling the core part 55 may be reduced to reduce inductance (L) properties, and the via pads 43 and 44 may be overgrown during a plating process of forming the via pads 43 and 44 to cause a short with respect to the adjacent coil conductor.

In an exemplary embodiment, the foregoing problem is solved by forming the first and second via pads 43 and 44 in such a manner that partial segments of the first and second via pads 43 and 44 are removed from circular upper surfaces thereof.

In general, in the related art, the via pads are provided to have a circular or quadrangular shape. However, edge regions of the circular or quadrangular via pads do not greatly affect a reduction in an open defect, while causing a short defect and a reduction in an area of the core part.

Thus, in an exemplary embodiment, the via pads 43 and 44 are formed by removing partial segments from a circular shape thereof, whereby a stable electrical connection between the first and second coils 41 and 42 may be secured, the area of the core part 55 may be maximized, and a short defect may be reduced.

Figure 3A:
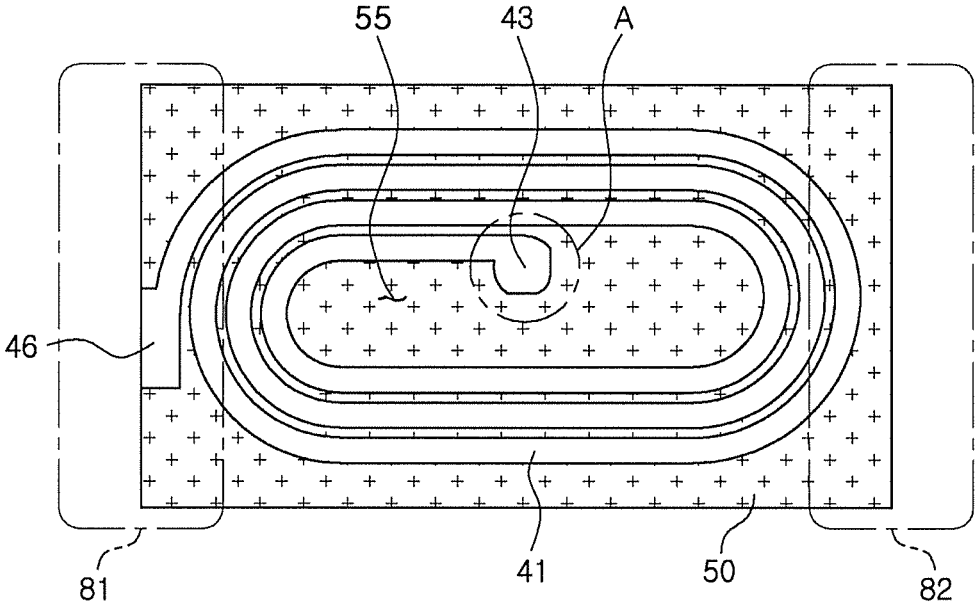
FIGS. 3A and 3B are schematic plan views illustrating via pads according to an exemplary embodiment in the present disclosure.
Figure 3B:
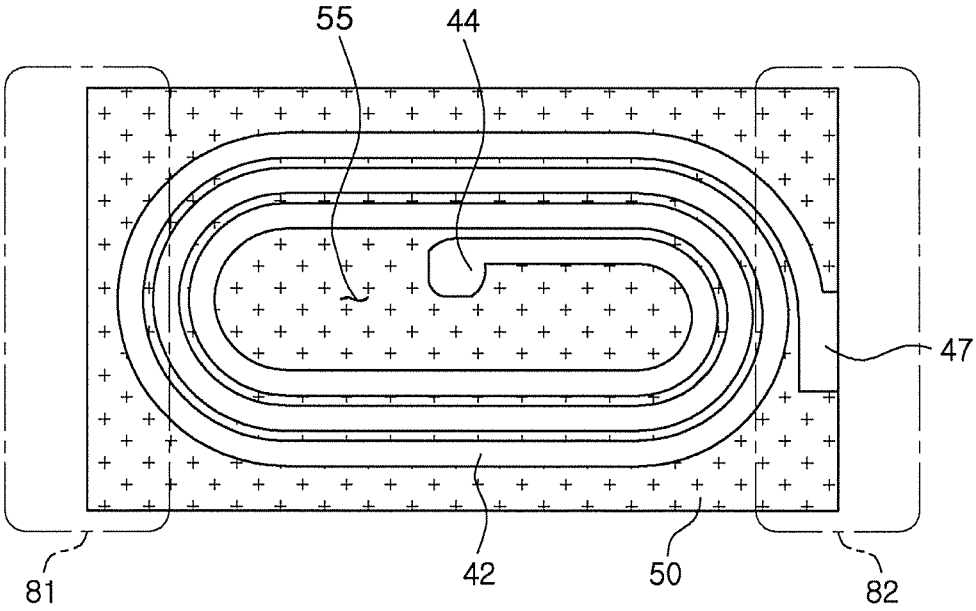

FIGS. 3(A) and 3(B) are schematic plan views illustrating via pads according to an exemplary embodiment.

Referring to FIGS. 3(A) and 3(B), the first and second via pads 43 and 44 protrude toward the core part 55. Here, as the first and second via pads 43 and 44 are increased in size, the area of the core part 55 formed at the inner portion of the coil conductors 41 and 42 is reduced, and a magnetic material filling the core part 55 is reduced, reducing the inductance (L) of the inductor.

In an exemplary embodiment, since the first and second via pads 43 and 44 have a shape formed by removing partial segments from a circular shape of the first and second via pads 43 and 44, a reduction in inductance (L) due to a reduction in area of the core part 55 is minimized, while securing a stable electrical connection between the first and second coils 41 and 42.

Details of the shape of the first and second via pads 43 and 44 will hereinafter be described.

The other end of the first coil 41 may extend to form a first lead-out portion 46 exposed to one end surface of the magnetic body 50 in the length (L) direction, and the other end of the second coil 42 may extend to forma second lead-out portion 47 exposed to the other end surface of the magnetic body 50 in the length (L) direction.

The first and second external electrodes 81 and 82 may be disposed on both end surfaces of the magnetic body 50 in the length (L) direction and connected to the first and second lead-out portions 46 and 47 exposed to both end surfaces of the magnetic body in the length (L) direction, respectively.

The first and second external electrodes 81 and 82 may include a metal having excellent electrical conductivity, such as copper (Cu), silver (Ag), nickel (Ni), tin (Sn), or alloys thereof.

Figure 4:
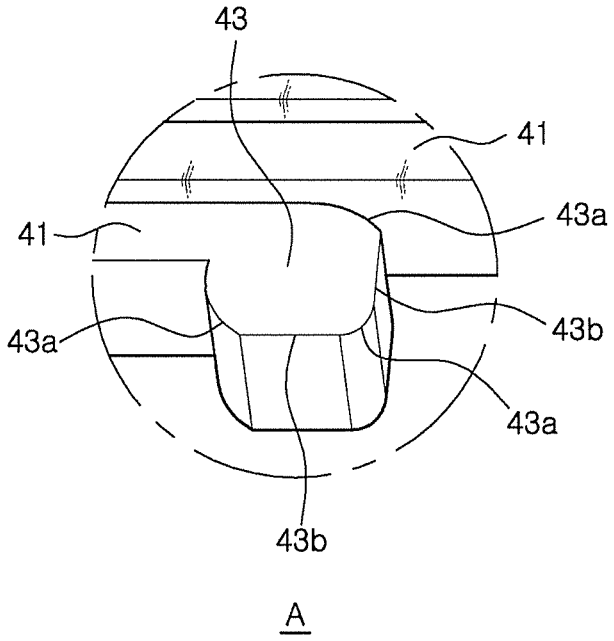
FIG. 4 is an enlarged perspective view illustrating a portion "A" of FIG. 3A.

FIG. 4 is an enlarged perspective view illustrating a portion "A" of FIG. 3(A).

Referring to FIG. 4, the via pad 43 according to an exemplary embodiment has a shape formed by removing a partial segment from an upper surface of the via pad 43 having a circular shape.

The rounded shape is not limited to a circle formed by points at a predetermined distance from the center thereof, and may be an oval having a longer axis and a shorter axis.

Alternatively, the upper surface of the via pad 43 according to an exemplary embodiment may have a quadrangular shape in which corner portions 43*a* are curved.

The upper surface of the via pad 43 according to an exemplary embodiment may have the corner portions 43*b* configured as circular arcs and linear portions 43*b* linking the corner portions 43*a*.

The upper surface of the via pad 43 may have a shape including a circular arc and the linear portion 43*b* by removing the segment from a circular shape.

Side surfaces of the first and second via pads 43 and 44 according to an exemplary embodiment having the upper surface in the aforementioned shape may have at least a plane and a curved surface linking the at least one plane.

Since the edge regions of the via pad 43 cause a short defect and a reduction in the area of the core part, while not greatly affecting a reduction in an open defect, the via pad 43 has a shape formed by removing a partial segment, the edge portion, from the via pad 43 having a circular shape in an exemplary embodiment. Thus, a short defect is prevented and a reduction in the area of the core part 55 is minimized, while a stable electrical connection between the first and second coils 41 and 42 without increasing an open defect is secured.

The shape of the first via pad 43 illustrated in FIG. 4 has been mainly described, and, like the first via pad 43, the second via pad 44 may have a shape formed by removing a partial segment from a circular upper surface thereof, and the second via pad 44 and the first via pad 43 may be provided to correspond to each other.

The first and second via pads 43 and 44 may be formed by performing electroplating. In detail, a plating resist may be patterned to have the aforementioned shape, and a patterned opening may be filled with a conductive material through plating.

After the plating resist as a photoresist film is applied, the plating resist may be patterned to have an intended shape through an exposure and developing method.

A seed pattern having an intended shape may be formed through the pattern plating using the plating resist, and electroplating may be further performed on the seed pattern to allow the seed pattern to be further grown to form the via pad.

However, without being limited thereto, any method may be applied as long as it can form the via pad having the aforementioned shape.

Figure 5:
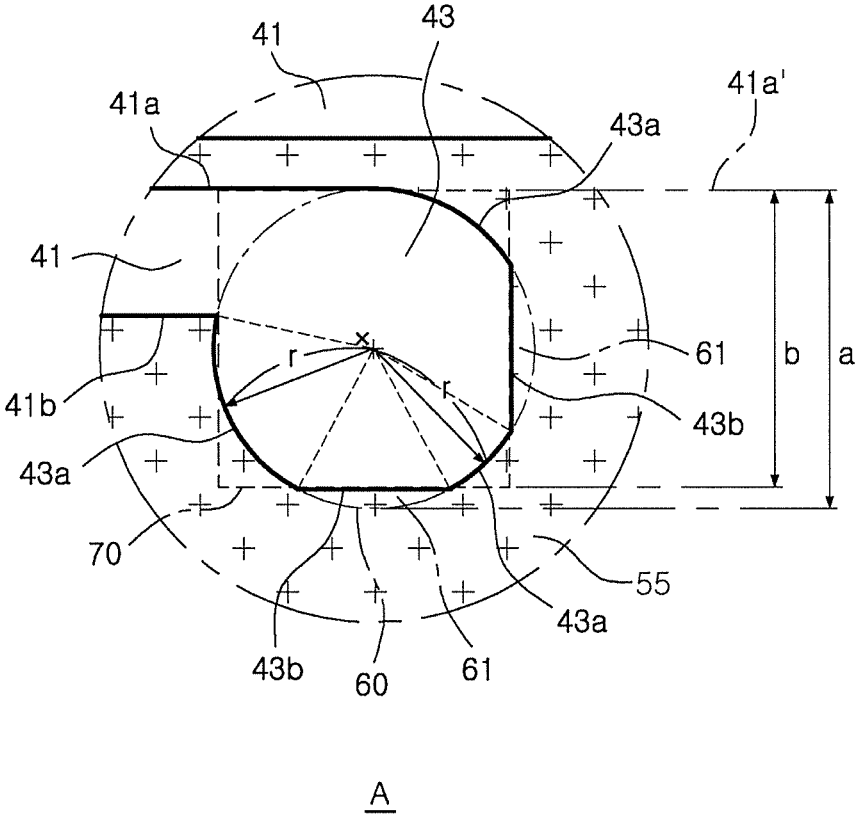
FIG. 5 is an enlarged plan view illustrating the portion "A" of FIG. 3A.

FIG. 5 is an enlarged plan view illustrating the portion "A" of FIG. 3(A).

Referring to FIG. 5, when a virtual square 70 is set over a rounded shape 60, the upper surface of the via pad 43 has a shape obtained by removing non-overlapping segment regions 61, resulting in a shape corresponding to overlapping regions of the virtual square 70 and the rounded shape 60.

When a side closer to the core part 55 is an inner coil line 41*b* and a side farther from the core part 55 is an outer coil line 41*a* in the first coil 41, one side of the virtual square 70 may be set to correspond to an extending line 41*a*' of the outer coil line 41*a* of one end of the first coil 41.

The other side of the virtual square 70 may be set to correspond to a boundary between one end of the first coil 41 and the via pad 43. Since the first coil 41 and the via pad 43 are integrally connected, there is no joint therebetween, and the first coil 41 and the via pad 43 may be differentiated from each other on the basis of a point from which the via pad 43 protrudes toward the core part 55, and here, the boundary between the first coil 41 and the via pad 43 may be set.

Preferably, a length b of one side of the virtual square 70 is smaller than a longer axis (a) of the rounded shape 60, for example, a diameter (a) of the rounded shape 60 when the rounded shape 60 is a circle formed with points at a predetermined distance from the center thereof.

The center of the virtual square 70 is positioned to be away from the center of the circle 60, closer to one end of the first coil 41 in a direction of the outer coil line 41*a* side of the first coil 41.

A difference between the longer axis (a) of the rounded shape 60 and the length (b) of the side of the virtual square 70 may be 30 μm or less.

When the difference between the longer axis (a) of the rounded shape 60 and the length (b) of the side of the virtual square 70 exceeds 30 μm, it may be difficult to realize the via pad having a shape formed by removing a partial segment from a circular shape, and it may also be difficult to stably electrically connect the first and second coils 41 and 42.

The plurality of corner portions 43*a* of the via pad 43 having a circular arc shape may have the same radius of curvature (r).

Since the via pad 43 according to an exemplary embodiment has a shape formed by removing a partial segment from a rounded shape formed with points at the predetermined distance from the center thereof, the plurality of corner portions 43*a* configured as circular arcs may have the same radius of curvature (r).

Here, however, in case of an oval, rather than a circle formed by points at the predetermined distance from the center thereof, the plurality of corner portions 43*a* may not have the same radius of curvature (r).

The shape of the first via pad 43 illustrated in FIG. 5 has been mainly described, and the second via pad 44 may extend from the second coil 44 and be formed on the other surface of the insulating substrate 20 to correspond to the first via pad 43.

As set forth above, according to exemplary embodiments, a short defect due to the via pad may be prevented, and loss of inductance due to an area of the via pad may be prevented.

While exemplary embodiments have been shown and described above, it will be apparent to those skilled in the art that modifications and variations could be made without departing from the scope of the present invention as defined by the appended claims.

What is claimed is:

1. A coil electronic component comprising:

a first coil disposed on a first surface of an insulating substrate;

a second coil disposed on a second surface of the insulating substrate opposing the first surface;

a via connecting the first and second coils through the insulating substrate;

a first via pad formed as one end of the first coil extending and disposed on the first surface of the insulating substrate to cover the via; and a second via pad formed as one end of the second coil extending and disposed on the second surface of the insulating substrate to cover the via, wherein upper surfaces of the first and second via pads have rounded corners, wherein the upper surfaces of the first and second via pads have a shape corresponding to overlapping regions of a rounded shape and a square having a side whose length is smaller than a longer axis of the rounded shape, and wherein a difference between the longer axis of the rounded shape and the length of the side of the virtual square is 30 μm or less.

2. The coil electronic component of claim 1, wherein one side of the square corresponds to an extending line of an outer coil line of one end of each of the first and second coils conductors.

3. The coil electronic component of claim 1, wherein the upper surfaces of the first and second via pads have corner portions configured as circular arcs and a straight line linking the corner portions.

4. The coil electronic component of claim 3, wherein a plurality of corner portions formed in the first via pad or the second via pad have the same radius of curvature.

5. The coil electronic component of claim 1, wherein a through hole is formed in a central portion of the insulating substrate and filled with a magnetic material to form a core part.

6. The coil electronic component of claim 5, wherein the first and second via pads protrude toward the core part.

7. The coil electronic component of claim 1, wherein the first and second coils and the first and second via pads are plated via pads.

8. The coil electronic component of claim 1, further comprising a magnetic body in which the first and second coils are embedded, wherein the magnetic body includes magnetic metal powder.

9. The coil electronic component of claim 1, wherein the first and second via pads extend to overlap first and second lead-out portions of the first and second coils, respectively.

10. The coil electronic component of claim 1, wherein a virtual circle connecting the rounded corners and an extending line of an outer coil line of one end of each of the first and second coils conductors have one contact point.

11. A coil electronic component comprising:

a first coil disposed on a first surface of an insulating substrate;

a second coil disposed on a second surface of the insulating substrate opposing the first surface;

a via connecting the first and second coils through the insulating substrate;

a first via pad formed as one end of the first coil extending and disposed on the first surface of the insulating substrate to cover the via; and a second via pad formed as one end of the second coil extending and disposed on the second surface of the insulating substrate to cover the via, wherein upper surfaces of the first and second via pads have a quadrangular shape in which corner portions are curved, wherein the upper surfaces of the first and second via pads have a shape corresponding to overlapping regions of a rounded shape and a square having a side whose length is smaller than a longer axis of the rounded shape, and wherein a difference between the longer axis of the rounded shape and the length of the side of the virtual square is 30 μm or less.

12. The coil electronic component of claim 11, wherein a plurality of corner portions formed in the first via pad or the second via pad have the same radius of curvature.

13. The coil electronic component of claim 11, wherein the upper surfaces of the first and second via pads have corner portions configured as circular arcs and linear portions linking the corner portions.

14. The coil electronic component of claim 11, wherein a through hole is provided in a central portion of the insulating substrate and filled with a magnetic material to form a core part.

15. The coil electronic component of claim 14, wherein the first and second via pads protrude toward the core part.

16. The coil electronic component of claim 11, wherein the first and second coils and the first and second via pads are plated via pads.

17. The coil electronic component of claim 11, wherein the first and second via pads extend to overlap first and second lead-out portions of the first and second coils, respectively.

* * * * *